US011021353B2

(12) United States Patent
Turnbull et al.

(10) Patent No.: US 11,021,353 B2
(45) Date of Patent: Jun. 1, 2021

(54) FORK CARRIAGE FOR A TRUCK MOUNTED FORKLIFT

(71) Applicant: Cargotec Research & Development Ireland Limited, Dundalk (IE)

(72) Inventors: Kevin Turnbull, Dundalk (IE); John Doyle, Dundalk (IE)

(73) Assignee: Cargotec Research & Development Ireland Limited, Dundalk (IE)

( * ) Notice: Subject to any disclaimer, the term of this patent is extended or adjusted under 35 U.S.C. 154(b) by 0 days.

(21) Appl. No.: 16/520,900

(22) Filed: Jul. 24, 2019

(65) Prior Publication Data

US 2020/0055713 A1 Feb. 20, 2020

(30) Foreign Application Priority Data

Jul. 24, 2018 (GB) ..... 1812047

(51) Int. Cl.
*B66F 9/19* (2006.01)
*B66F 9/08* (2006.01)
*B66F 9/20* (2006.01)

(52) U.S. Cl.
CPC ..... *B66F 9/195* (2013.01); *B66F 9/08* (2013.01); *B66F 9/20* (2013.01)

(58) Field of Classification Search
CPC .. B66F 9/08; B66F 9/122; B66F 9/195; B66F 9/20
USPC ..... 414/664
See application file for complete search history.

(56) References Cited

U.S. PATENT DOCUMENTS

| | | | | |
|---|---|---|---|---|
| 2,639,051 | A * | 5/1953 | Thomas | B66F 9/195 414/661 |
| 9,309,097 | B2 * | 4/2016 | O'Keeffe | B66F 9/146 |
| 9,994,435 | B2 * | 6/2018 | Hasler | B66F 9/122 |
| 10,501,296 | B2 * | 12/2019 | O'Keeffe | B66F 9/122 |
| 10,589,970 | B1 * | 3/2020 | Hamlik | B66F 9/195 |
| 10,807,849 | B2 * | 10/2020 | Weiss | B66F 9/08 |
| 2019/0337784 | A1 * | 11/2019 | Weiss | B66F 9/07 |

* cited by examiner

*Primary Examiner* — James Keenan
(74) *Attorney, Agent, or Firm* — Brian J. Colandreo; Michael T. Abramson; Holland & Knight LLP

(57) ABSTRACT

This invention relates to a fork carriage for a truck mounted forklift, the fork carriage comprising an upright rear section for mounting onto the lifting assembly of the forklift, an upright forward section, shorter than the upright rear section, for reception of tines, and a pantograph linkage connecting the upright rear section and upright forward sections together. The pantograph linkage comprises a first and second linkage arm however the second linkage arm is shorter than the first linkage arm and does not extend all the way forward to the upright forward section. Instead, there is provided a third linkage arm with a hinge joint along its length, the third linkage arm being connected at various positions along its length to each of the first linkage arm, the second linkage arm and the upright forward section. In this way, the pantograph linkage can achieve the same reach with a lower upright forward section and access to top far side loads is facilitated.

20 Claims, 5 Drawing Sheets

PRIOR ART

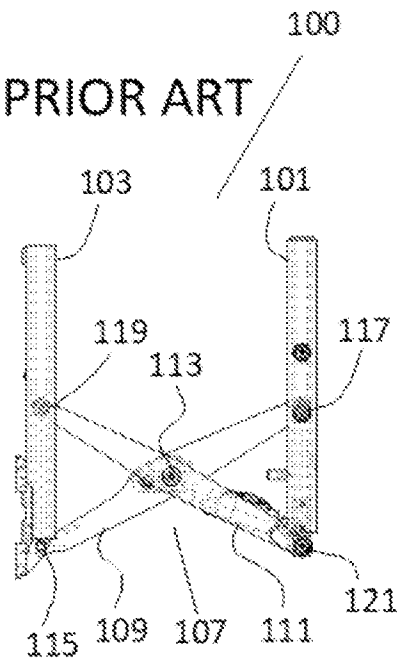
Fig. 2
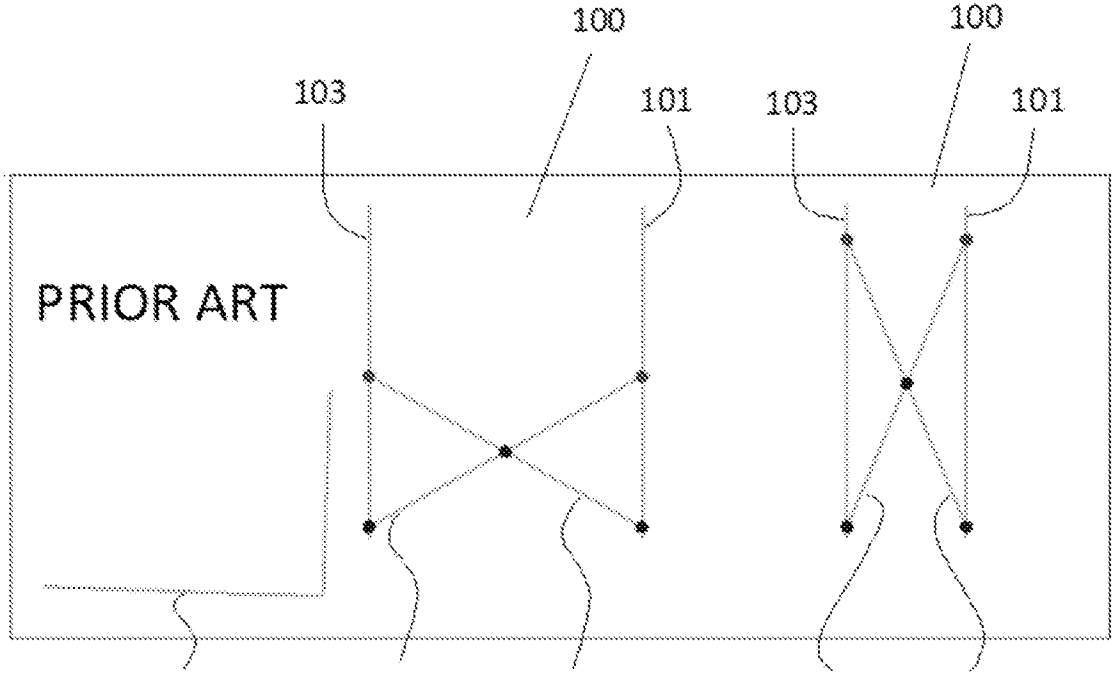
Fig. 3(A)
Fig. 3(B)

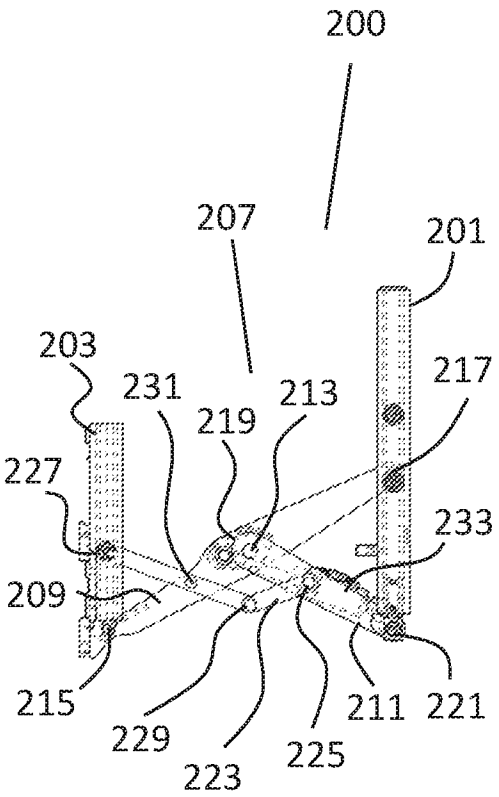
Fig. 4
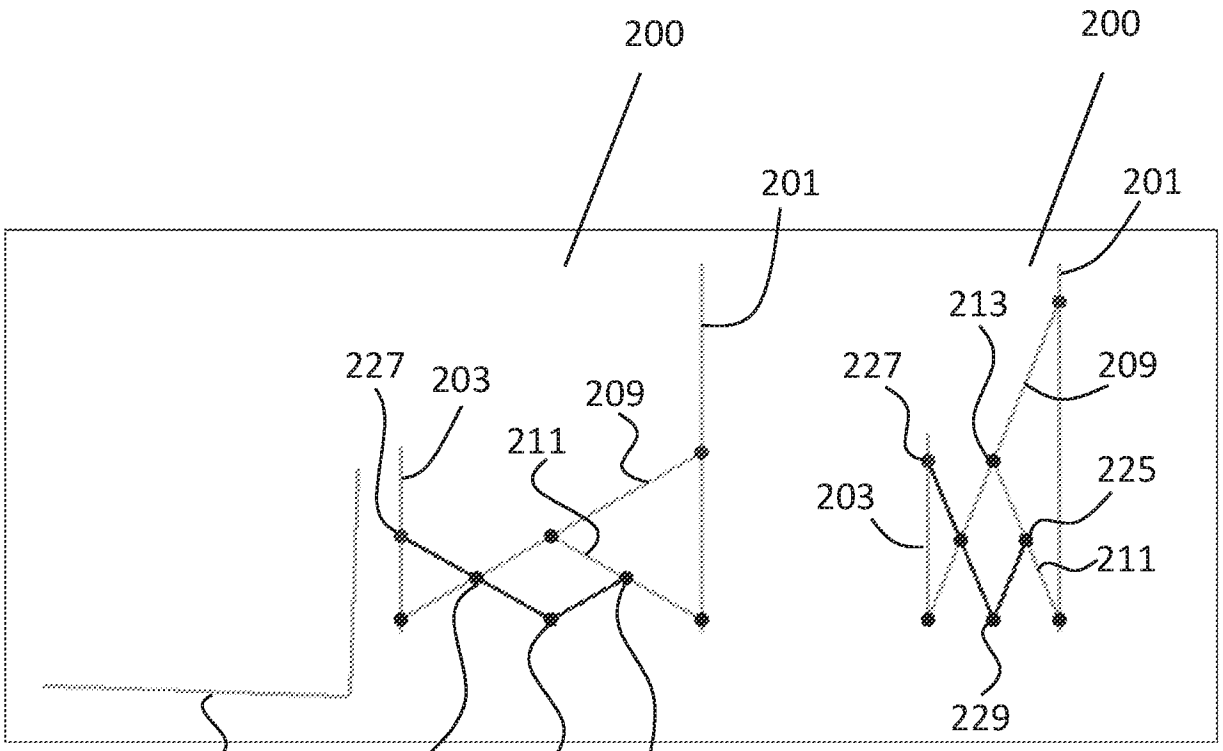
Fig. 5(B)
Fig. 5(A)

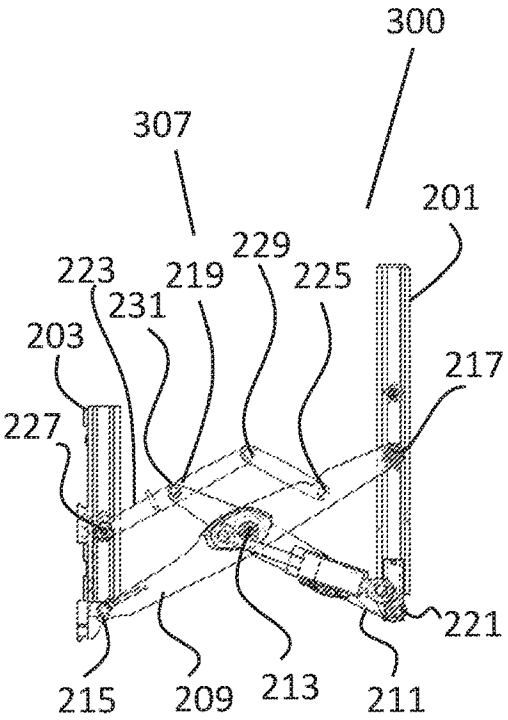
Fig. 6
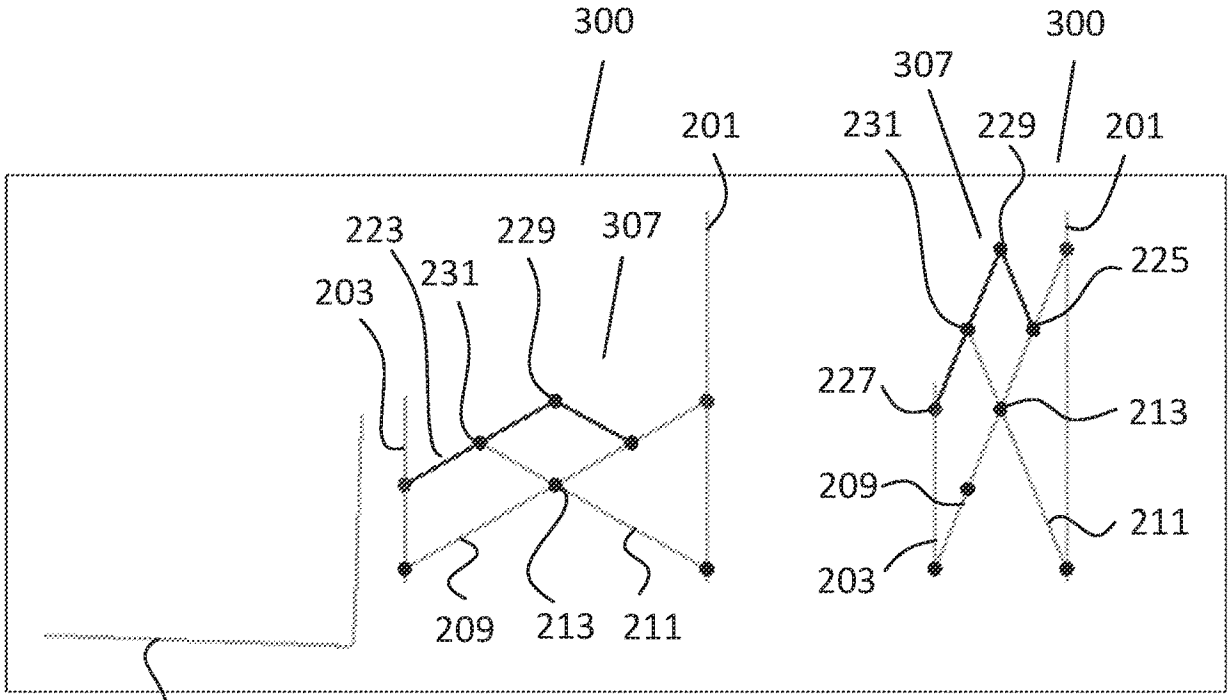
Fig. 7(B)
Fig. 7(A)

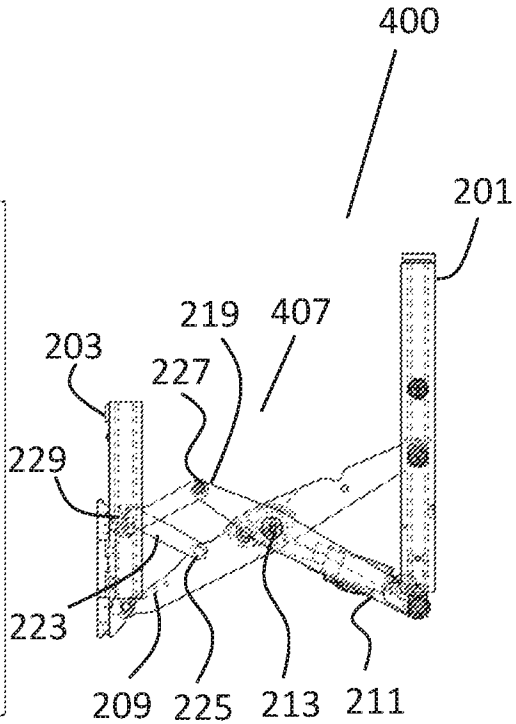
Fig. 8
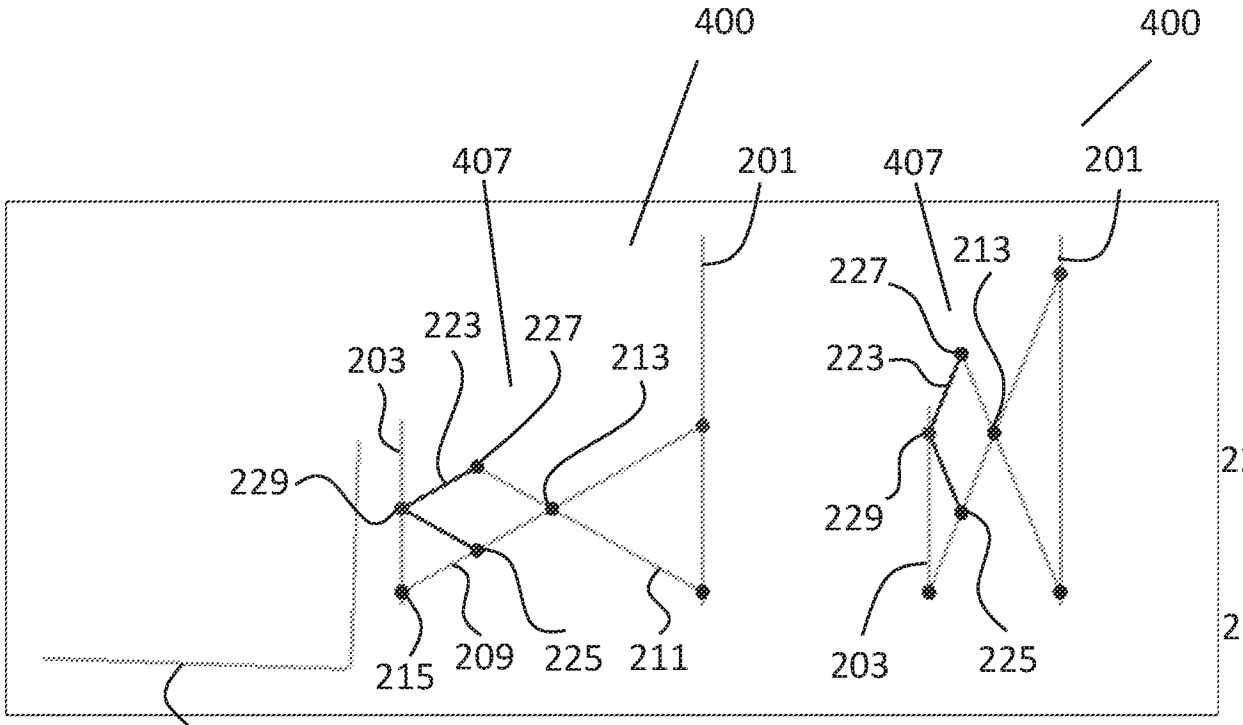
Fig. 9(B)
Fig. 9(A)

FORK CARRIAGE FOR A TRUCK MOUNTED FORKLIFT

RELATED APPLICATIONS

This application is based on and claims the benefit of priority from United Kingdom Patent Application No. 1812047.7, filed 24 Jul. 2018, the entire disclosure of which is incorporated herein by reference.

TECHNICAL FIELD OF THE INVENTION

This invention relates to a fork carriage for a truck mounted forklift. In particular, the present invention relates to a fork carriage for a truck mounted forklift that has a pantograph linkage to extend the reach of the forks.

BACKGROUND OF THE INVENTION

Truck mounted forklift trucks are provided with a number of different lifting assemblies including, inter alia, static mast and moving mast arrangements. In order to improve the reach of the forklift truck and facilitate far side loading and unloading of goods to and from the bed of a carrying vehicle, it is known to provide a fork carriage with a pantograph linkage. The fork carriage with pantograph linkage can enable the tines of the truck mounted forklift's lifting assembly to reach these far side loads.

There is however a problem with the known embodiments of fork carriages with pantograph linkages. Heretofore, the known embodiments of fork carriages with pantograph linkages require a tall upright forward section. This tall upright forward section is necessary to allow the bearing at the end of the pantograph linkage arm to travel upwards when the pantograph is in a retracted configuration. As a result, when attempting to engage top far side loads, the fork carriage may be prevented from engaging a top far side load by the roof of the carrying vehicle. This will require the goods to be engaged from the opposite side of the carrying vehicle which will require either the forklift to be moved to the other side of the vehicle or for the carrying vehicle to be moved. Either way, this increases the amount of time required for the loading or unloading operation which is undesirable.

Other important requirements of truck mounted forklift trucks are that they must be lightweight and they must not protrude too far from the rear of the carrying vehicle. The heavier the forklift, the less carrying capacity of the carrying vehicle there will be for goods. Therefore, it is essential to keep the truck mounted forklift as light as possible. The amount by which the forklift protrudes from the rear of the carrying vehicle, referred to as overhang, is also important as this dimension is restricted by law in many jurisdictions. Furthermore, the greater the overhang, the greater the forces imparted on the forks during transit as well as during mounting and dismounting of the forklift from the carrying vehicle. Greater forces require reinforcement of the forks, increasing the weight of the forklift. Pantograph linkages will inherently increase the overhang of the forklift so it is desirable to have the pantograph linkage as compact as possible when they are in a retracted configuration.

It is an object of the present invention to provide a fork carriage for a truck mounted forklift that overcomes at least some of the above-identified problems and provides a useful choice for the consumer.

SUMMARY OF THE INVENTION

According to the invention there is provided a fork carriage for a truck mounted forklift truck comprising an upright rear section for mounting onto the lifting assembly of a truck mounted forklift truck, an upright forward section, shorter than the upright rear section, for reception of tines, and a pantograph linkage connecting the upright rear section and the upright forward section together, the pantograph linkage comprising:

- a first linkage arm and a second linkage arm connected together about a first pivot joint intermediate their ends:
- the first linkage arm having a forward end and a rearward end, the forward end being pivotably mounted adjacent the bottom of the upright forward section and the rearward end being slidably mounted for reciprocal movement upwards and downwards along the upright rear section;
- the second linkage arm having a forward end and a rearward end, the rearward end being pivotably mounted adjacent the bottom of the upright rear section and the second linkage arm being shorter than the first linkage arm so that the forward end of the second linkage arm terminates before reaching the upright forward section;
- a third linkage arm having a first end and a second end, the third linkage arm being cranked intermediate its ends about a hinge joint, and in which: the first end of the third linkage arm is pivotably connected to one of the first linkage arm and the second linkage arm; the second end of the third linkage arm is either: (i) pivotably connected to the other of the first linkage arm and the second linkage arm with the hinge joint slidably mounted for reciprocal movement upwards and downwards along the upright forward section; or (ii) is slidably mounted for reciprocal movement upwards and downwards along the upright forward section with the portion of the third linkage arm intermediate the hinge joint and the second end being connected to the other of the first linkage arm and the second linkage arm about a second pivot joint.

By having such a fork carriage, the height of the upright forward section will be greatly decreased and the fork carriage can be used for loading and unloading far top side loads without fear of being impeded by the roof of the carrying vehicle. Advantageously, the pantograph linkage will be compact so that when the pantograph is retracted when the forklift is mounted on a carrying vehicle, the overhang of the forklift will not be increased substantially.

In one embodiment of the invention there is provided a fork carriage for a truck mounted forklift in which the second linkage arm extends beyond the first pivot joint.

In one embodiment of the invention there is provided a fork carriage for a truck mounted forklift in which the first end of the third linkage arm is pivotably connected to the first linkage arm, the second end of the third linkage arm is pivotably connected to the end of the second linkage arm that extends beyond the first pivot joint, and the hinge joint is slidably mounted for reciprocal movement upwards and downwards along the upright forward section. This is seen as a particularly preferred embodiment of the present invention that will enable reduced height of the upright forward section while at the same time allowing the linkage arms to collapse into a compact configuration.

In one embodiment of the invention there is provided a fork carriage for a truck mounted forklift in which the first end of the third linkage arm is pivotably connected to the first linkage arm at a point along the first linkage arm away from the upright rear section so that the first end and the second end of the third linkage arm are equidistant from the upright rear section. In this way, the linkage will be symmetrical resulting in horizontal movement of the tines as they are extended or retracted. This is important for ensuring that the load is stable on the tines and for ease of manipulation of the load.

In one embodiment of the invention there is provided a fork carriage for a truck mounted forklift in which the hinge joint is located centrally along the length of the third linkage arm. Again, this will provide symmetry allowing the tines to move horizontally as the pantograph linkage is extended or retracted.

In one embodiment of the invention there is provided a fork carriage for a truck mounted forklift in which the first end of the third linkage arm is pivotably connected to the first linkage arm and the second end of the third linkage arm is slidably mounted for reciprocal movement upwards and downwards along the upright forward section with the portion of the third linkage arm intermediate the hinge joint and the second end being connected to the end of the second linkage arm about the second pivot joint. This is another useful embodiment of the present invention. Although in this embodiment, the pantograph linkage will still be relatively tall when partially extended, the configuration provides for better load distribution than alternative configurations and when extended will be substantially lower than the existing configurations.

In one embodiment of the invention there is provided a fork carriage for a truck mounted forklift in which the first end of the third linkage arm is pivotably connected to the first linkage arm at a point along the first linkage arm so that the first end of the third linkage arm and the second pivot joint are at the same height above the ground. In this way, the linkage will be symmetrical resulting in horizontal movement of the tines as they are extended or retracted. This is important for ensuring that the load is stable on the tines and for ease of manipulation of the load.

In one embodiment of the invention there is provided a fork carriage for a truck mounted forklift in which the first end of the third linkage arm is pivotably connected to the second linkage arm at a point along the arm intermediate the upright rear section and the first hinge joint, and the second end of the third linkage arm is slidably mounted for reciprocal movement upwards and downwards along the upright forward section with the portion of the third linkage arm intermediate the hinge joint and the second end being connected to the first linkage arm about a second pivot joint. In this embodiment, a very low profile pantographic linkage component is provided. However, as a trade-off, without careful arrangement of the linkage arms, the pantograph linkage may have a greater fore and aft dimension in a collapsed state, thereby increasing the overhang of the forklift from the carrying vehicle.

In one embodiment of the invention there is provided a fork carriage for a truck mounted forklift in which the first end of the third linkage arm is pivotably connected to the second linkage arm at a point along the second linkage arm so that the first end of the third linkage arm and the second pivot joint are at the same height above the ground. In this way, the linkage will be symmetrical resulting in horizontal movement of the tines as they are extended or retracted. This is important for ensuring that the load is stable on the tines and for ease of manipulation of the load.

In one embodiment of the invention there is provided a fork carriage for a truck mounted forklift in which there is provided an actuating cylinder to expand and retract the pantograph linkage, one end of which is connected to the upright rear section and the other end of which is connected to one of the first linkage arm and the second linkage arm.

In one embodiment of the invention there is provided a fork carriage for a truck mounted forklift in which the actuating cylinder is connected at one of its ends to the upright rear section adjacent the base thereof and is connected to the first linkage arm at its other end.

In one embodiment of the invention there is provided a truck mounted forklift comprising a U-shaped chassis having a pair of forwardly projecting side bars bridged by a rear crossbar, a wheel located adjacent the front of each of the side bars and a steered rear wheel mounted on the rear crossbar, a driver's station mounted on one side of the chassis and a motive power unit mounted on the other side of the chassis, a lifting assembly mounted on the assembly intermediate the side bars, and in which the lifting assembly comprises an upright mast having mounted thereon a fork carriage as claimed in any of the preceding claims.

BRIEF DESCRIPTION OF THE DRAWINGS

The invention will now be more clearly understood from the following description of some embodiments thereof given by way of example only with reference to the accompanying drawings, in which:—

FIG. 2 is a side view of a fork carriage with pantograph linkage known in the art;

FIGS. 3(A) and 3(B) are diagrammatic representations of the fork carriage of FIG. 2 in an extended and a retracted configuration respectively;

FIG. 4 is a side view of a first embodiment of fork carriage according to the invention;

FIGS. 5(A) and 5(B) are diagrammatic representations of the fork carriage of FIG. 4 in an extended and a retracted configuration respectively;

FIG. 6 is a side view of a second embodiment of fork carriage according to the invention;

FIGS. 7(A) and 7(B) are diagrammatic representations of the fork carriage of FIG. 6 in an extended and a retracted configuration respectively;

FIG. 8 is a side view of a third embodiment of fork carriage according to the invention; and FIGS. 9(A) and 9(B) are diagrammatic representations of the fork carriage of FIG. 8 in an extended and a retracted configuration respectively.

DETAILED DESCRIPTION OF THE INVENTION

Figure 1:
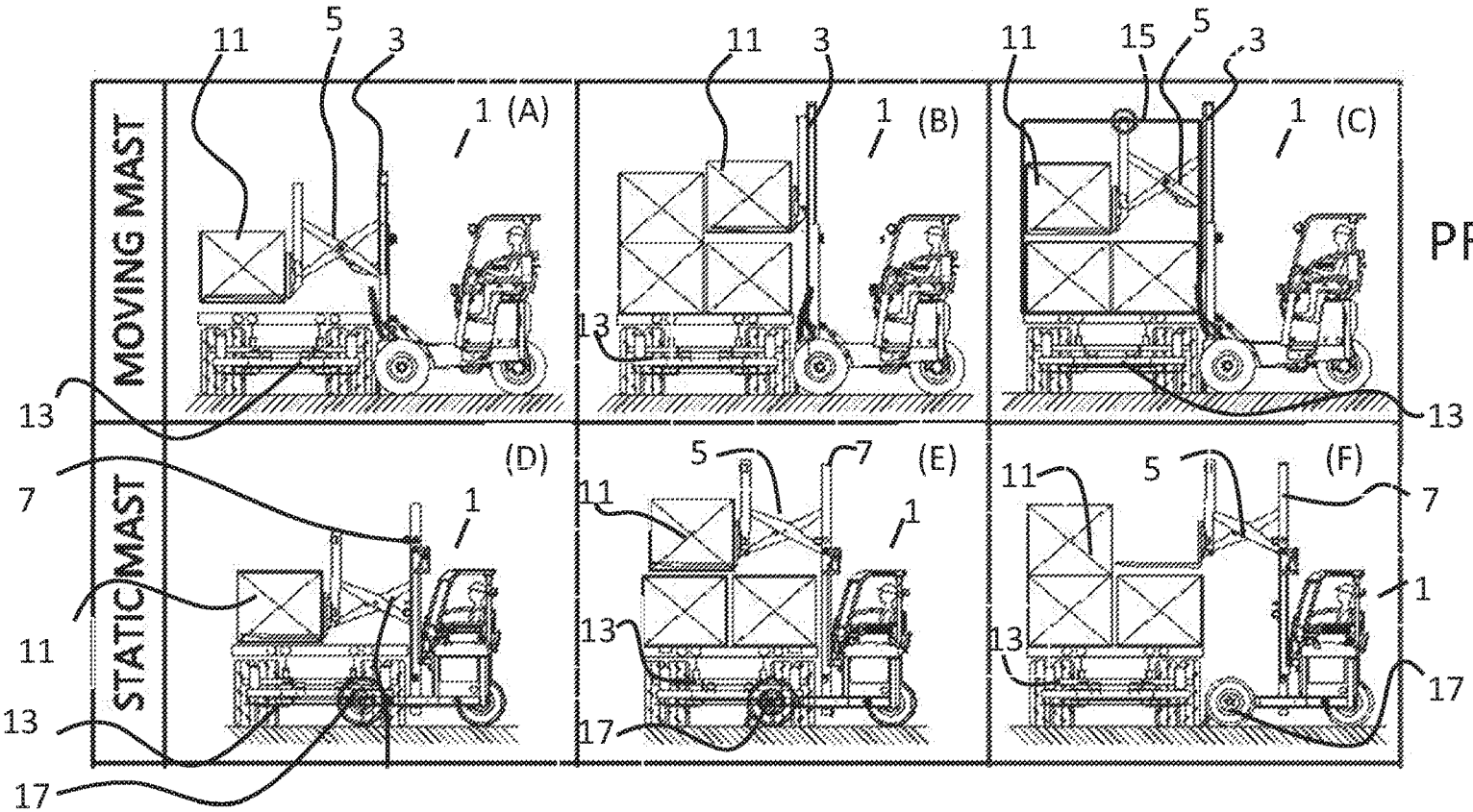
FIG. 1 illustrates truck mounted forklifts with lifting assemblies having fork carriages with pantograph linkages known in the art.

Referring to FIG. 1 (A) to 1 (F) inclusive, there are shown views of truck mounted forklifts with lifting assemblies having extendable fork carriages with pantograph linkages known in the art. FIG. 1 (A) to 1 (C) illustrate a truck mounted forklift 1 with a movable mast 3 having a fork carriage with a pantograph linkage 5. In other words, the mast is mounted on a carriage (not shown) that is moveable forwards and backwards on the chassis. FIG. 1 (D) to 1 (F) illustrate a truck mounted forklift 1 with a static mast 7 having a fork carriage with a pantograph linkage 5. The static mast, as its name suggests, is in a fixed position on the forklift chassis.

Referring specifically to FIG. 1 (A) to 1 (C), the truck mounted forklift with a movable mast is illustrated engaging a load 11 in a variety of positions on a carrying vehicle 13. In FIG. 1 (A) the truck mounted forklift 1 is shown engaging a load 11 located in the bottom far side position of the carrying vehicle. The movable mast 3 is positioned forwards on the forklift 1 and the pantograph linkage 5 is fully extended. In FIG. 1 (B) the truck mounted forklift 1 is shown engaging a load 11 located in the top near side position of the carrying vehicle. It can be seen that there are no impediments to the lifting assembly engaging loads in these positions. In FIG. 1 (C) the truck mounted forklift 1 is shown attempting to engage a load in the top far side position on the carrying vehicle. It can be seen that the pantograph linkage comes into contact with the underside of the roof 15 of the carrying vehicle 13 (indicated by the circled portion of FIG. 1(C)). In this position, the upright forward section of the fork carriage is impeded by the roof of the carrying vehicle. Accordingly, this lifting assembly is unable to engage loads in the top far side position on the carrying vehicle.

Referring specifically to FIG. 1 (D) to 1 (F), the truck mounted forklift with a static mast is illustrated engaging a load 11 in a variety of positions on a carrying vehicle 13. In FIG. 1 (D) the truck mounted forklift 1 is shown engaging a load 11 located in the bottom far side position of the carrying vehicle. The front wheels 17 of the truck mounted forklift 1 are positioned under the carrying vehicle 13. The static mast 7 is in position on the forklift 1 and the pantograph linkage 5 is fully extended. In FIG. 1 (E) the truck mounted forklift 1 is shown engaging a load 11 located in the top far side position of the carrying vehicle 13 (with the roof of the carrying vehicle removed). Again, the front wheels 17 are positioned under the carrying vehicle. It can be seen that the static mast 7 and the pantograph linkage 5 extend significantly upwards of the load 11 and the upright forward section will be obstructed by the roof of the trailer (not shown) similar to FIG. 1(C) above. In FIG. 1 (F) the truck mounted forklift 1 is shown attempting to engage a load in the top far side position on the carrying vehicle. It can be seen that the front wheels 17 are not positioned under the carrying vehicle 13. It is not uncommon for the wheels of the carrying vehicle to impede the progression of the front wheels 17 of the forklift under the carrying vehicle 13. Furthermore, the roof (not shown) of the carrying vehicle would prevent further progression of the forks towards the load. Accordingly, this lifting assembly is unable to engage loads in the top far side position on the carrying vehicle.

Referring to FIGS. 2, 3(A) and 3(B), there is shown a fork carriage for a truck mounted forklift truck known in the art, indicated generally by the reference numeral 100. The fork carriage comprises an upright rear section 101 for mounting onto the lifting assembly (not shown) of a truck mounted forklift truck, an upright forward section 103 for reception of tines 105, and a pantograph linkage 107 connecting the upright rear section 101 and the upright forward section 103 together. The pantograph linkage comprises a first linkage arm 109 and a second linkage arm 111 connected together about a first pivot joint 113 intermediate their ends. The first linkage arm 109 has a forward end 115 pivotably mounted adjacent the bottom of the upright forward section and a rearward end 117 slidably mounted for reciprocal movement upwards and downwards along the upright rear section 101. The second linkage arm 111 has a forward end 119 slidably mounted for reciprocal movement upwards and downwards along the upright forward section 103 and a rearward end 121 pivotably mounted adjacent the bottom of the upright rear section 101. The first linkage arm 109 and the second linkage arm 111 are the same length as each other and the upright forward section 103 and the upright rear section 101 are effectively the same height as each other.

Referring to FIGS. 4, 5(A) and 5(B), there is shown a fork carriage for a truck mounted forklift according to the invention, indicated generally by the reference numeral 200. The fork carriage comprises an upright rear section 201 for mounting onto the lifting assembly (not shown) of a truck mounted forklift truck, an upright forward section 203 (shorter than the upright rear section) for reception of tines 205, and a pantograph linkage 207 connecting the upright rear section 201 and the upright forward section 203 together. The pantograph linkage comprises a first linkage arm 209 and a second linkage arm 211 connected together about a first pivot joint 213 intermediate their ends.

The first linkage arm 209 has a forward end 215 pivotably mounted adjacent the bottom of the upright forward section and a rearward end 217 slidably mounted for reciprocal movement upwards and downwards along the upright rear section 201. The second linkage arm 211 has a forward end 219 and a rearward end 221, the rearward end 221 being pivotably mounted adjacent the bottom of the upright rear section 201. The second linkage arm 211 is shorter than the first linkage arm 209 so that the forward end 219 of the second linkage arm 211 terminates before reaching the upright forward section 203.

In addition to the upright forward section 203 being shorter than the upright rear section 201, the pantograph linkage 207 comprises a third linkage arm 223 having a first end 225 and a second end 227. The third linkage arm is cranked intermediate its ends about a hinge joint 229. The first end 225 of the third linkage arm is pivotably connected to the second linkage arm 211 and the second end 227 of the third linkage arm 223 is slidably mounted for reciprocal movement upwards and downwards along the upright forward section 203. A portion of the third linkage arm 223 intermediate the hinge joint 229 and the second end 227 is connected to the first linkage arm 209 about a second pivot joint 231. An actuating cylinder 233 is provided with one end thereof connected to the upright rear section 201 and the other end thereof connected to the first linkage arm. Operation of the actuating cylinder will cause expansion or retraction of the pantograph linkage 207. The second pivot joint 231 and the first end 225 of the third linkage arm are at substantially the same height above the ground, thereby providing a symmetrical pantograph linkage that will permit horizontal movement of the tines as the pantograph is expanded and retracted. In this embodiment, the upright forward section 203 is very low, permitting access to far side loads without impacting against the roof of a carrying vehicle.

Referring to FIGS. 6, 7(A) and 7(B), there is shown an alternative embodiment of fork carriage for a truck mounted forklift according to the invention, indicated generally by the reference numeral 300, where like parts have been given the same reference numeral as before. The pantograph linkage 307 differs from the pantograph linkage 207 shown in FIGS. 4, 5(A) and 5(B) in that the first end 225 of the third linkage arm 223 is pivotably connected to the first linkage arm 209 instead of being pivotably connected to the second linkage arm 211. The second end 227 of the third linkage arm is still slidably mounted for reciprocal movement upwards and downwards along the upright forward section 203, however the portion of the third linkage arm intermediate the hinge joint 229 and the second end 227 is connected to the second linkage arm 211 instead of the first linkage arm 209 about a second pivot joint 231. The second pivot joint, in this instance, is located adjacent the forward end 219 of the second linkage arm 211.

Again, it will be seen that the first end 225 of the third linkage arm and the second pivot joint 231 are at substantially the same height above the ground, thereby providing a symmetrical pantograph linkage that will permit horizontal movement of the tines 205 as the pantograph is expanded and retracted. In this embodiment, the upright forward section 203 is still quite low however it will be appreciated that when in a fully contracted configuration (as illustrated on FIG. 7(B)), the hinge joint 229 of the pantograph linkage will be relatively high. In some cases, this may require at least partial expansion of the pantograph linkage 307 before it passes under the roof of a carrying vehicle. The height clearance is no longer an issue once the pantograph linkage is partially expanded. In this embodiment, although there is a trade off with the height of the contracted pantograph linkage, there will be better load distribution across the pantograph linkage components, thereby potentially allowing lighter components to be provided than the embodiment shown in FIGS. 4, 5(A) and 5(B).

Referring to FIGS. 8, 9(A) and 9(B), there is shown a third embodiment of fork carriage for a truck mounted forklift according to the invention, indicated generally by the reference numeral 400, where like parts have been given the same reference numeral as before. The fork carriage 400 differs from the embodiments shown in FIGS. 4 to 7 inclusive in that the hinge joint 229 of the third linkage arm 223 of the pantograph linkage 407 is slidably mounted for reciprocal movement upwards and downwards along the upright forward section 203. The first end 225 of the third linkage arm 223 is pivotably connected to the forward end 219 of the second linkage arm 211 and the second end 227 of the third linkage arm 223 is pivotably connected to the first linkage arm 209 at a point intermediate the first pivot joint 213 and the forward end 215 of the first linkage arm. This configuration is particularly preferred as it will collapse into a compact configuration while providing a low upright forward section 203. It can be seen that the first end 225 and the second end 227 of the third linkage arm are substantially equidistant from the upright rear section 201, thereby providing a symmetrical pantograph linkage that will permit substantially horizontal movement of the forks as the pantograph linkage is expanded and retracted.

It will be understood that various modifications to the foregoing may be made to provide a low profile upright forward section of the fork carriage with pantograph linkage. Indeed, the precise positioning of the pivot connections and hinge joints as well as the length of the various linkage arms can be determined based on the reach requirements of the forklift. The upright forward section 203 is of the order of 50% to 80% of the height of the upright rear section 201.

In this specification the terms "comprise, comprises, comprised and comprising" and the terms "include, includes, included and including" are all deemed totally interchangeable and should be afforded the widest possible interpretation.

The invention is not limited to the embodiments hereinbefore described but may be varied in both construction and detail within the scope of the appended claims.

The invention claimed is:

1. A fork carriage for a truck mounted forklift truck comprising an upright rear section for mounting onto the lifting assembly of a truck mounted forklift truck, an upright forward section, shorter than the upright rear section, for reception of tines, and a pantograph linkage connecting the upright rear section and the upright forward section together, the pantograph linkage comprising:

a first linkage arm and a second linkage arm connected together about a first pivot joint intermediate their ends:

the first linkage arm having a forward end and a rearward end, the forward end being pivotably mounted adjacent the bottom of the upright forward section and the rearward end being slidably mounted for reciprocal movement upwards and downwards along the upright rear section;

the second linkage arm having a forward end and a rearward end, the rearward end being pivotably mounted adjacent the bottom of the upright rear section and the second linkage arm being shorter than the first linkage arm so that the forward end of the second linkage arm terminates before reaching the upright forward section;

a third linkage arm having a first end and a second end, the third linkage arm being cranked intermediate its ends about a hinge joint, and in which: the first end of the third linkage arm is pivotably connected to one of the first linkage arm and the second linkage arm; the second end of the third linkage arm is either: (i) pivotably connected to the other of the first linkage arm and the second linkage arm with the hinge joint slidably mounted for reciprocal movement upwards and downwards along the upright forward section; or (ii) is slidably mounted for reciprocal movement upwards and downwards along the upright forward section with a portion of the third linkage arm intermediate the hinge joint and the second end being connected to the other of the first linkage arm and the second linkage arm about a second pivot joint.

2. The fork carriage for a truck mounted forklift as claimed in claim 1 in which the second linkage arm extends beyond the first pivot joint.

3. The fork carriage for a truck mounted forklift as claimed in claim 2 in which the first end of the third linkage arm is pivotably connected to the first linkage arm, the second end of the third linkage arm is pivotably connected to the end of the second linkage arm that extends beyond the first pivot joint, and the hinge joint is slidably mounted for reciprocal movement upwards and downwards along the upright forward section.

4. The fork carriage for a truck mounted forklift as claimed in claim 3 in which the first end of the third linkage arm is pivotably connected to the first linkage arm at a point along the first linkage arm away from the upright rear section so that the first end and the second end of the third linkage arm are equidistant from the upright rear section.

5. The fork carriage for a truck mounted forklift as claimed in claim 4 in which the hinge joint is located centrally along the length of the third linkage arm.

6. The fork carriage for a truck mounted forklift as claimed in claim 3 in which the hinge joint is located centrally along the length of the third linkage arm.

7. The fork carriage for a truck mounted forklift as claimed in claim 3 in which there is provided an actuating cylinder to expand and retract the pantograph linkage, one end of which is connected to the upright rear section and the other end of which is connected to one of the first linkage arm and the second linkage arm.

8. The fork carriage for a truck mounted forklift as claimed in claim 7 in which the actuating cylinder is connected at one of its ends to the upright rear section adjacent the base thereof and is connected to the first linkage arm at its other end.

9. The fork carriage for a truck mounted forklift as claimed in claim 2 in which the first end of the third linkage arm is pivotably connected to the first linkage arm and the second end of the third linkage arm is slidably mounted for reciprocal movement upwards and downwards along the upright forward section with the portion of the third linkage arm intermediate the hinge joint and the second end being connected to the end of the second linkage arm about the second pivot joint.

10. The fork carriage for a truck mounted forklift as claimed in claim 9 in which the first end of the third linkage arm is pivotably connected to the first linkage arm at a point along the first linkage arm so that the first end of the third linkage arm and the second pivot joint are at the same height above the ground.

11. The fork carriage for a truck mounted forklift as claimed in claim 9 in which there is provided an actuating cylinder to expand and retract the pantograph linkage, one end of which is connected to the upright rear section and the other end of which is connected to one of the first linkage arm and the second linkage arm.

12. The fork carriage for a truck mounted forklift as claimed in claim 11 in which the actuating cylinder is connected at one of its ends to the upright rear section adjacent the base thereof and is connected to the first linkage arm at its other end.

13. The fork carriage for a truck mounted forklift as claimed in claim 2 in which the first end of the third linkage arm is pivotably connected to the second linkage arm at a point along the second linkage arm intermediate the upright rear section and the first hinge joint, and the second end of the third linkage arm is slidably mounted for reciprocal movement upwards and downwards along the upright forward section with the portion of the third linkage arm intermediate the hinge joint and the second end being connected to the first linkage arm about a second pivot joint.

14. The fork carriage for a truck mounted forklift as claimed in claim 13 in which the first end of the third linkage arm is pivotably connected to the second linkage arm at a point along the second linkage arm so that the first end of the third linkage arm and the second pivot joint are at the same height above the ground.

15. The fork carriage for a truck mounted forklift as claimed in claim 1 in which the first end of the third linkage arm is pivotably connected to the second linkage arm at a point along the second linkage arm intermediate the upright rear section and the first hinge joint, and the second end of the third linkage arm is slidably mounted for reciprocal movement upwards and downwards along the upright forward section with the portion of the third linkage arm intermediate the hinge joint and the second end being connected to the first linkage arm about the second pivot joint.

16. The fork carriage for a truck mounted forklift as claimed in claim 15 in which the first end of the third linkage arm is pivotably connected to the second linkage arm at a point along the second linkage arm so that the first end of the third linkage arm and the second pivot joint are at the same height above the ground.

17. The fork carriage for a truck mounted forklift as claimed in claim 15 in which there is provided an actuating cylinder to expand and retract the pantograph linkage, one end of which is connected to the upright rear section and the other end of which is connected to one of the first linkage arm and the second linkage arm.

18. The fork carriage for a truck mounted forklift as claimed in claim 17 in which the actuating cylinder is connected at one of its ends to the upright rear section adjacent the base thereof and is connected to the first linkage arm at its other end.

19. The fork carriage for a truck mounted forklift as claimed in claim 1 in which there is provided an actuating cylinder to expand and retract the pantograph linkage, one end of which is connected to the upright rear section and the other end of which is connected to one of the first linkage arm and the second linkage arm.

20. A truck mounted forklift having mounted thereon a fork carriage as claimed in claim 1.

* * * * *